US005713755A

United States Patent [19]

Koopman et al.

[11] Patent Number: 5,713,755

[45] Date of Patent: Feb. 3, 1998

[54] SURFACE MOUNT CONNECTORS HAVING STAKED ALIGNMENT PINS

[75] Inventors: Steven P. Koopman, Floyds Knobs; Doug E. McCartin, Henryville, both of Ind.

[73] Assignee: Samtec, Inc., New Albany, Ind.

[21] Appl. No.: 526,161

[22] Filed: Sep. 11, 1995

[51] Int. Cl.[6] ..... H01R 13/629

[52] U.S. Cl. ..... 439/378; 439/571

[58] Field of Search ..... 439/83, 571–573, 439/378, 374

[56] References Cited

U.S. PATENT DOCUMENTS

| | | | |
|---|---|---|---|
| 3,409,861 | 11/1968 | Barnes et al. | 339/174 |
| 3,815,077 | 6/1974 | Anhalt et al. | 339/17 |
| 3,873,173 | 3/1975 | Anhalt | 339/17 |
| 4,010,992 | 3/1977 | Crimmins et al. | 339/17 |
| 4,236,777 | 12/1980 | Merlina et al. | 339/17 |
| 4,340,266 | 7/1982 | Grovender | 339/17 |
| 4,358,173 | 11/1982 | Conrad | 339/17 |
| 4,417,777 | 11/1983 | Bamford | 339/17 |
| 4,614,387 | 9/1986 | Hartl | 339/17 |
| 4,659,156 | 4/1987 | Johnescu et al. | 439/378 |
| 5,277,597 | 1/1994 | Masami et al. | 439/83 |
| 5,487,674 | 1/1996 | Guzik et al. | 439/83 |
| 5,584,725 | 12/1996 | Tseng et al. | 439/572 |

OTHER PUBLICATIONS

IBM Technical Disclosure Bulletin, "Retention Device for Connector Subassembly", vol. 33, No. 9, pp. 15–17. 439/573, Feb. 1991.

*Primary Examiner*—Gary F. Paumen

*Attorney, Agent, or Firm*—Woodard, Emhardt, Naughton, Moriarty & McNett

[57] ABSTRACT

Surface mount connectors having staked alignment pins. The bodies of the connectors are formed without alignment pins, and alignment pins are thereafter staked into the bottom surface of the connector body in order to positively locate the connector when mounting to a printed circuit board. Because the alignment pins are not integrally formed with the connector bodies, the connectors may be inventoried in only long strips of, for example, 50 positions. After a customer order is received, the long strips may be cut to the desired number of positions. The alignment pins are thereafter staked into the connector body in order to form a completed connector. The present invention therefore obviates the need to inventory connectors with alignment pins in each of the potentially desired sizes.

6 Claims, 2 Drawing Sheets

SURFACE MOUNT CONNECTORS HAVING STAKED ALIGNMENT PINS

TECHNICAL FIELD OF THE INVENTION

The present invention generally relates to electrical connectors and, more particularly, to surface mount connectors having staked alignment pins.

BACKGROUND OF THE INVENTION

Electrical connectors are commonly used in the electronics industry in order to facilitate the interconnection of various components, usually by a plurality of conductive wires. Such connectors are typically formed as a row of a specified number of positions, with each position containing one or more connection sites. For example, a twelve position dual in-line connector will have twelve positions of two pins each, for a total of 24 pins or connection sites.

Electrical connectors may generally be divided into two classes: through-hole connectors and surface mount connectors. Through-hole connectors include conductive pins which protrude from their bottom surfaces and extend through holes formed in the printed circuit board to which the through-hole connector is mounted. Each of these pins is soldered to a conductive trace on the opposite side of the printed circuit board from the connector body. For example, if a through-hole connector has 24 pins, 24 holes will be formed in the printed circuit board with the same dimensional spacing between the through-holes as between the connector pins.

When a through-hole connector is mounted onto a printed circuit board, each of the connector pins extends through a respective through-hole in the printed circuit board. There can therefore be no misalignment between the mounted connector and the printed circuit board, because the through-holes positively locate the connector mounting position.

Surface mount connectors, on the other hand, do not mount to the printed circuit board using through-holes. A typical surface mount connector includes a conductive lead for each position protruding from the bottom surface of the connector. Each of these leads is formed in a curved configuration, such that the lead rests on a conductive pad on the surface of the printed circuit board, rather than extending through a through-hole in the board. The surface mount leads are soldered to these conductive pads.

Because no part of the surface mount connector extends through the printed circuit board, it is relatively easy to misalign the connector with respect to the pads when mounting the connector to the board. This is due to the fact that there are no through-holes or connector pins to positively locate the surface mount connector with respect to the printed circuit board surface.

In order to prevent such misalignment, prior art surface mount connectors have been constructed with alignment pins integrally formed with the connector body and protruding perpendicular to the bottom surface of the connector. Corresponding alignment holes are then formed in the printed circuit board, so that interaction between the alignment pins and the alignment holes will positively locate the surface mount connector on the surface of the printed circuit board. Such connectors are typically formed with one alignment pin near each end of the connector.

Surface mount connectors with alignment pins work well in locating the connector on the printed circuit board, however they are an inconvenience to connector manufacturers. This is because surface mount connectors without alignment pins may be inventoried by the connector manufacturer in only long strips of, for example, 50 positions. When a customer order is received, these long strips may be "cut to position" in order to form a connector of the desired number of positions. This obviates the need for the manufacturer to carry connectors with various numbers of positions in inventory, thus reducing inventory carrying costs.

This scheme will not work, however, if the connector must include an alignment pin on each end. Because the long strips must be able to be cut to any number of positions, it is not possible to know in advance where to locate the alignment pins. This necessitates the custom molding of such connectors in various sizes (i.e. various numbers of positions) with alignment pins near each end. A supply of each connector size must then be carried in inventory, greatly increasing the inventory carrying costs over such costs for connectors without alignment pins.

There is therefore a need in the prior art for a surface mount connector design which includes alignment pins, but which allows for the connectors to be inventoried in long strips and then cut to position as orders are received. The present invention is directed toward meeting this need.

SUMMARY OF THE INVENTION

The present invention relates to surface mount connectors having staked alignment pins. The bodies of the connectors are formed without alignment pins, and alignment pins are thereafter staked into the bottom surface of the connector body in order to positively locate the connector when mounting to a printed circuit board. Because the alignment pins are not integrally formed with the connector bodies, the connectors may be inventoried in only long strips of, for example, 50 positions, After a customer order is received, the long strips may be cut to the desired number of positions. The alignment pins are thereafter staked into the connector body in order to form a completed connector. The present invention therefore obviates the need to inventory connectors with alignment pins in each of the potentially desired sizes.

In one form of the invention, a surface mount connector is disclosed, comprising a connector body; a plurality of connector pins coupled to the connector body, each of the plurality of connector pins including a surface mounting pad; and at least one alignment pin staked into a surface of the connector body.

In another form of the invention, a surface mount connector is disclosed, comprising a connector body having a bottom surface, the bottom surface including at least one staking hole formed therein; a plurality of connector pins coupled to the connector body, each of the plurality of connector pins including a surface mounting pad; and at least one alignment pin staked into said at least one staking hole.

In another form of the invention, a method of forming a surface mount connector is disclosed, comprising the steps of: (a) providing a connector strip having a first number of positions; (b) cutting the connector strip to form a connector having a second number of positions, wherein the second number is less than the first number; and (c) staking at least one alignment pin into a surface of the connector.

DETAILED DESCRIPTION OF THE PREFERRED EMBODIMENTS

Figure 2:
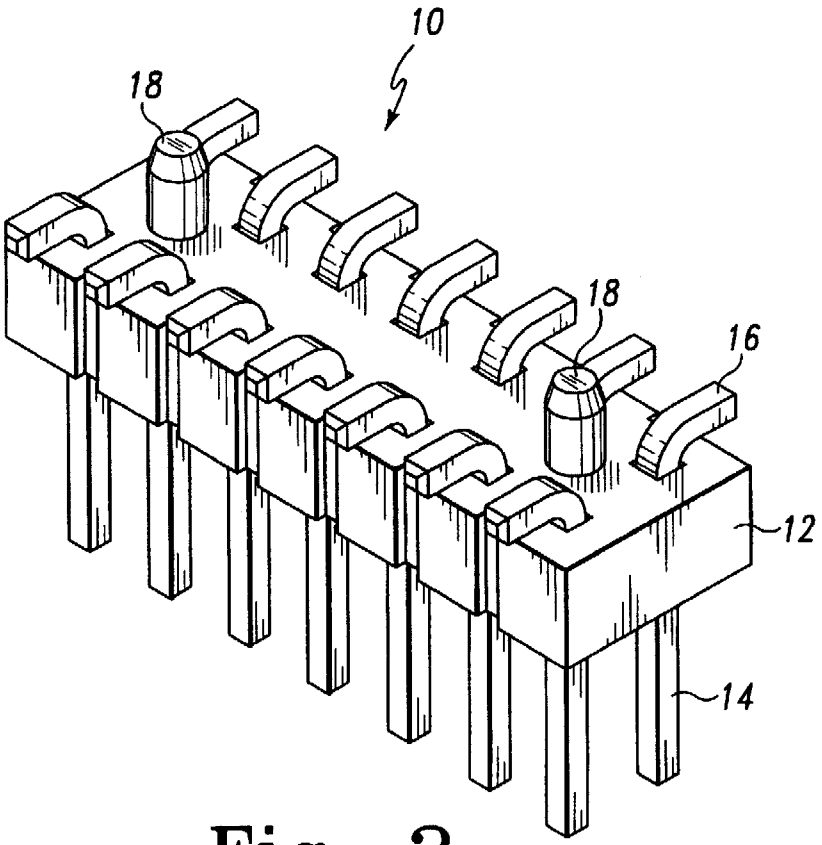
FIG. 2 is a perspective view of the first embodiment surface mount connector of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
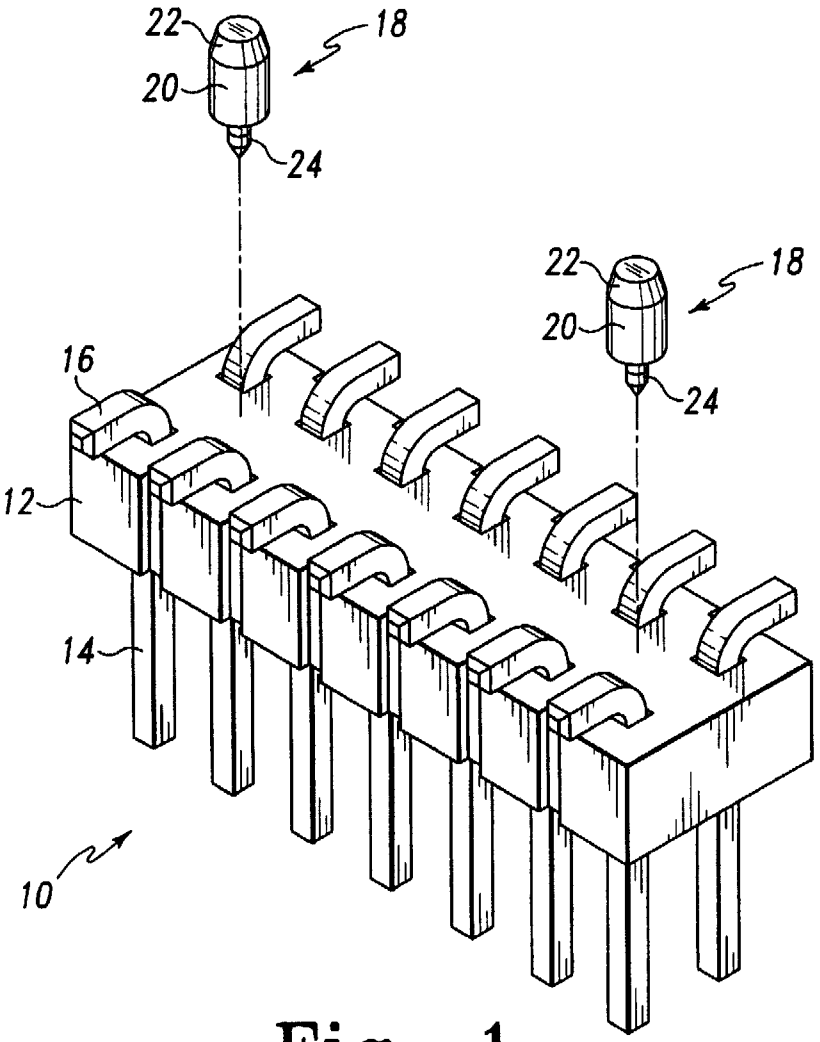
FIG. 1 is an exploded perspective view of a first embodiment surface mount connector of the present invention.

A first embodiment of the present invention is illustrated in an exploded perspective view in FIG. 1, and indicated generally at 10. The connector 10 includes a connector body 12 which holds a plurality of connector pins 14, as is known in the art. The connector body 12 is preferably made from injection molded plastic, while the connector pins 14 may be made of any conductive metal, such as copper. The connector 10 is illustrated in FIG. 1 inverted from its normal position on the circuit board. Each of the plurality of pins 14 include a curved lower portion 16 which extends substantially transverse to the longitudinal axis of the pin 14. Each of the portions 16 form a surface mounting pad for the connector 10, the connector 10 typically being soldered to corresponding circuit traces on a circuit board (not shown).

A pair of alignment pins 18 are illustrated with the connector 10 in an exploded configuration, thereby illustrating the connector 10 in a preassembled form. Each of the alignment pins 18 include a central cylindrical body 20 having a frustoconical crown portion 22 integrally formed therewith. A pointed staking pin 24 is formed on the end of the cylinder 20 opposite the crown portion 22.

The alignment pins 18 are preferably formed such that the pointed staking pins 24 may be driven into the bottom surface of the connector body 24. The alignment pins 18 are illustrated staked into the surface of the connector body 12 in FIG. 2, thereby forming a completed surface mount connector 10 having alignment pins 18 which may be used to positively locate the position of the connector 10 when mounting it to a printed circuit board (not shown).

It will be appreciated by those skilled in the art that the connector body 12 with integral connector pins 14 may be inventoried by the connector manufacturer in long strips of, for example, 50 positions. When a customer order for surface mount connectors having alignment pins is received, the manufacturer may cut the long strips to the desired number of positions, and thereafter stake the alignment pins 18 to each end of the connector body 12, thereby forming the completed surface mount connector 10 having alignment pins. Of course, the alignment pins 18 may be staked into the connector body 12 prior to cutting the connector from the long inventory strip.

By forming the alignment pins as discrete parts which may be staked into the plastic of the connector body 12, surface mount connectors with alignment pins may be formed to any number of positions from the standard long strips. This is because the alignment pins may be added to the connectors after the desired number of positions has been determined. The use of connectors constructed according to the present invention eliminates the need for connector manufacturers to carry connectors in inventory which contain all of the foreseeable desired number of positions. As explained hereinabove, such is the case with prior art surface mount connectors which have integral alignment pins because the alignment pins must be formed at the time that the connector body 12 is formed so that the alignment pins will end up near the ends of the connector body, as is desired. However, with the design of the present invention, the alignment pins 18 may be added after the final length of the connector is determined, therefore the connector bodies 12 may be inventoried only in the long strips and later cut to position after customer orders have been received.

It will be appreciated by those skilled in the art that the exact configuration of the alignment pins 18 is not critical. The frustoconical crown 22 of the first embodiment of the present invention is desirable in order to facilitate mating of the alignment pins 18 with the corresponding alignment holes in the circuit board (not shown). However, any design for the alignment pin 18 will work so long as the alignment pin 18 includes a sharpened portion which is able to penetrate the connector body 12 during the staking operation and a portion which protrudes from the surface of the connector body 12 in order to pass through the corresponding alignment hole.

Figure 4:
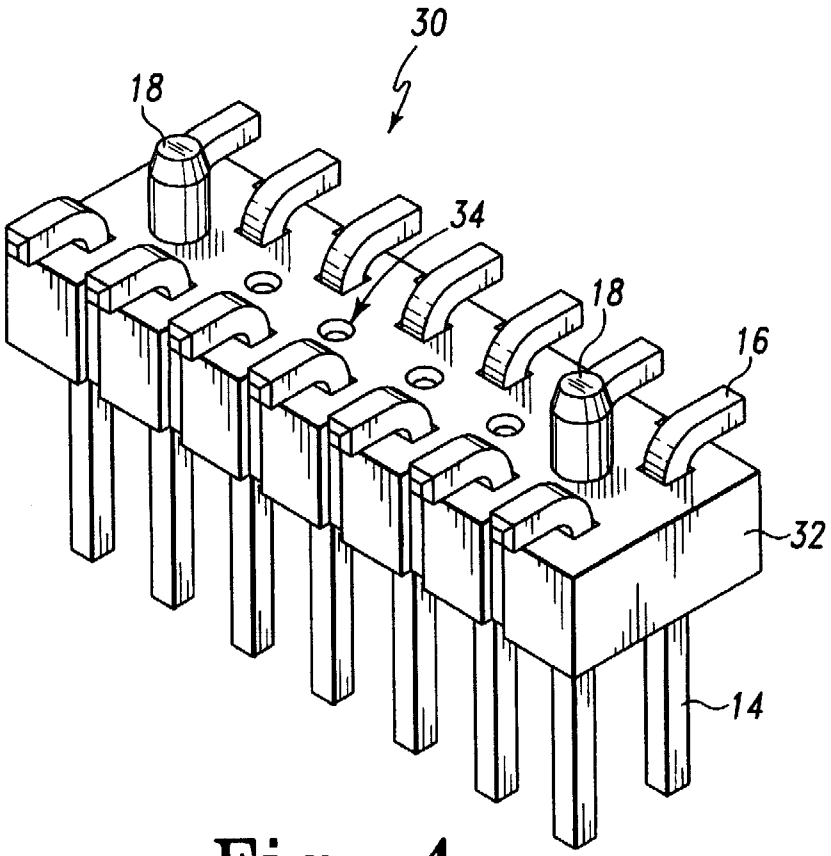
FIG. 4 is a perspective view of the second embodiment surface mount connector of the present invention.
Figure 3:
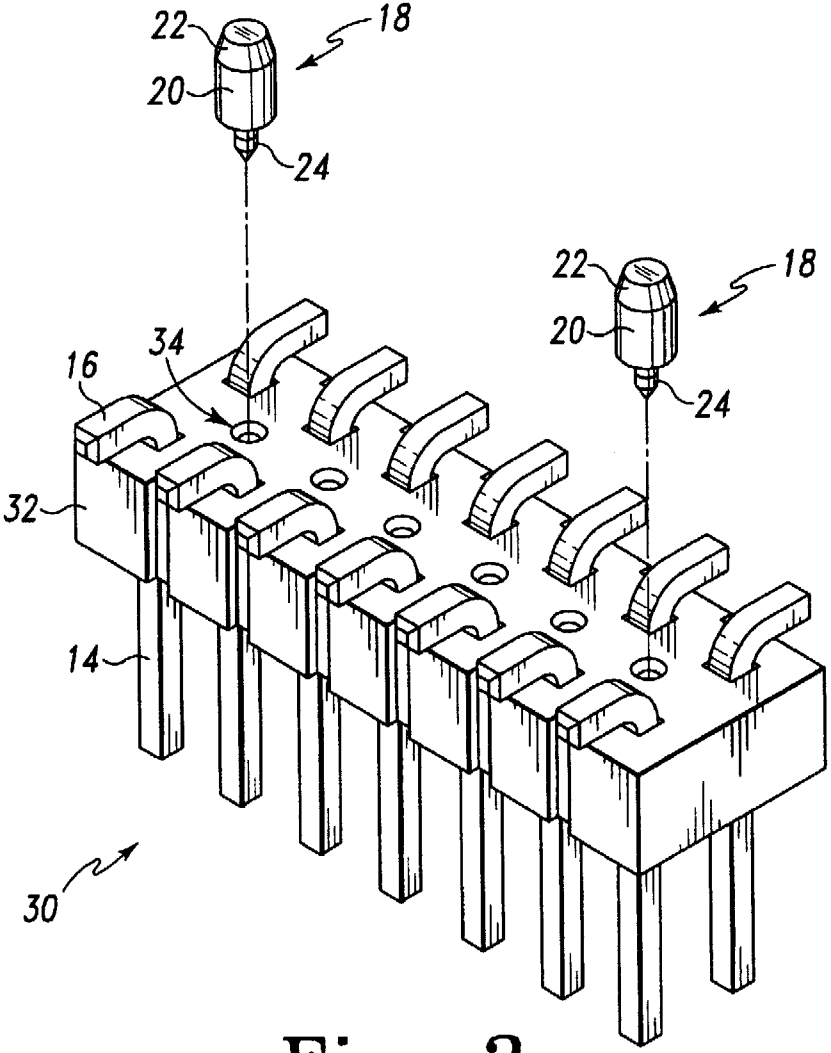
FIG. 3 is an exploded perspective view of a second embodiment surface mount connector of the present invention.

A second embodiment of the present invention is illustrated in an exploded perspective view in FIG. 3, and indicated generally at 30. The second embodiment surface mount connector 30 is substantially identical to the first embodiment surface mount connector 10 of FIGS. 1 and 2, with the exception that connector 30 includes a connector body 32 having preformed staking holes 34 formed at regular intervals along its longitudinal length. It is not necessary that the staking holes 34 extend completely through the connector body 32. The staking holes 34 facilitate positioning and insertion of the alignment pins 18. The alignment pins 18 are shown installed on the connector body 32 in the view of FIG. 4. The connector bodies 32 may be formed in long strips of, for example, 50 positions, just like the connector bodies 12. The presence of the staking holes 34 at regular intervals on the connector body 32 in no way hinders the ability to cut such long strips to position in order to form connectors 30 of any desired number of positions. In a preferred embodiment, the staking holes 34 are formed with a diameter that is slightly smaller than the diameter of the pointed staking pin 24 of the alignment pins 18. This allows the alignment pins 18 to be securely mounted within the staking holes 34 after assembly of the connector 30.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A surface mount connector, comprising:

a connector body;

a plurality of connector pins coupled to the connector body, each of the plurality of connector pins including a surface mounting pad; and at least one alignment pin separately formed from the connector body, each alignment pin having a staking pin at one end thereof staked into a surface of the connector body.

2. The surface mount connector of claim 1, wherein the connector body is injection molded plastic.

3. The surface mount connector of claim 1, wherein each of the plurality of connector pins is substantially J-shaped.

4. The surface mount connector of claim 1, wherein each of the plurality of connector pins extends through the connector body.

5. The surface mount connector of claim 1, wherein each alignment pin comprises:

a cylindrical body portion;

a frustoconical crown portion adjacent one end of the cylindrical body portion.

6. The surface mount connector of claim 1, wherein the at least one alignment pin comprises:

a first alignment pin staked into the surface of the connector body near a first end of the connector body; and a second alignment pin staked into the surface of the connector body near a second end of the connector body.

* * * * *